US005106135A

United States Patent [19]

Menke et al.

[11] Patent Number: 5,106,135

[45] Date of Patent: Apr. 21, 1992

[54] MOTOR-VEHICLE DOOR LATCH

[75] Inventors: Johannes T. Menke, Velbert; Ulrich Köstler, Unterschleissheim, both of Fed. Rep. of Germany

[73] Assignee: Kiekert GmbH & Co. Kommanditgesellschaft, Heiligenhaus, Fed. Rep. of Germany

[21] Appl. No.: 487,735

[22] Filed: Mar. 2, 1990

[30] Foreign Application Priority Data

Mar. 14, 1989 [DE] Fed. Rep. of Germany ..... 3908183

[51] Int. Cl.[5] ..... E05C 3/26

[52] U.S. Cl. ..... 292/216; 292/336.3; 292/DIG. 27

[58] Field of Search ..... 292/336.3, DIG. 3, DIG. 23, 292/216, DIG. 27

[56] References Cited

U.S. PATENT DOCUMENTS

| | | | |
|---|---|---|---|
| 2,869,912 | 1/1959 | Becker, Jr. et al. | 292/336.3 |
| 3,190,682 | 6/1965 | Fox et al. | 292/216 |
| 3,206,240 | 9/1965 | Roethel | 292/DIG. 23 |
| 3,596,482 | 8/1971 | Pollack | 292/216 |
| 4,054,307 | 10/1977 | Carella et al. | 292/336.3 |
| 4,097,077 | 6/1978 | Gahrs | 292/216 |
| 4,586,737 | 5/1986 | Arlauskas | 292/216 |
| 4,978,154 | 12/1990 | Kleefeldt et al. | 292/216 |

FOREIGN PATENT DOCUMENTS

| | | | |
|---|---|---|---|
| 2161854A | 1/1986 | United Kingdom | 292/216 |

*Primary Examiner*—Eric K. Nicholson

*Assistant Examiner*—Darnell M. Boucher

*Attorney, Agent, or Firm*—Herbert Dubno; Andrew Wilford

[57] ABSTRACT

A latch for a motor-vehicle door comprises a housing, a door bolt engageable in and separable from the housing, a pivotal lock fork in the housing engageable around the bolt, and a release lever operatively coupled to the lock fork. Inside and outside latching elements respectively accessible and actuatable from inside and outside the door can each displace a common latching lever pivotal in the housing between a latched position and an unlatched position. Inside and outside locking elements respectively accessible and actuatable from inside and outside the door can similarly displace a common locking lever pivotal in the housing between a locked and an unlocked position. A coupling element connected to the locking lever is displaceable thereby between coupling and uncoupling positions respectively corresponding to the unlocked and locked positions of the locking lever. The coupling element is connected between the latching lever and the release lever only in the coupling position for displacement of the release lever into the freeing position only on displacement of the common latching lever into the unlatched position. A coupling is operatively engaged between the inside latching element and the inside locking element for shifting the latter into the unlocking position on actuation of the former. Thus actuation of the inside latching element with the latch locked unlocks the latch such that subsequent actuation of the inside latching element unlocks the door.

5 Claims, 6 Drawing Sheets

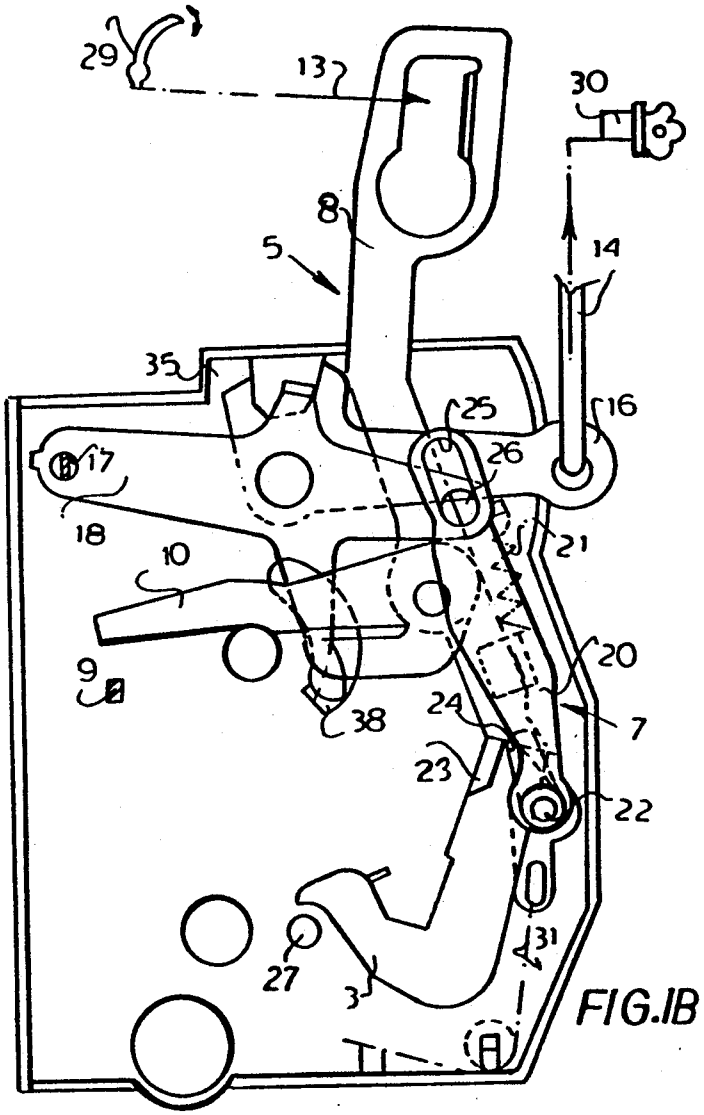
FIG.IB
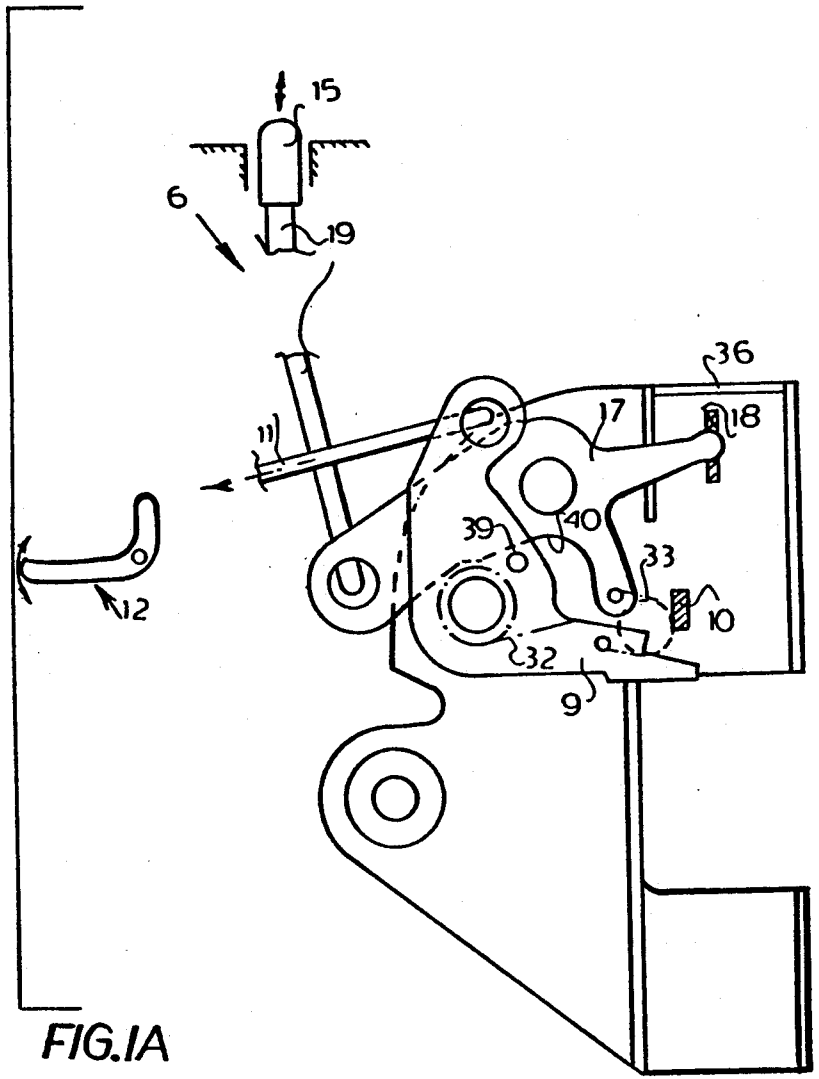
FIG.IA

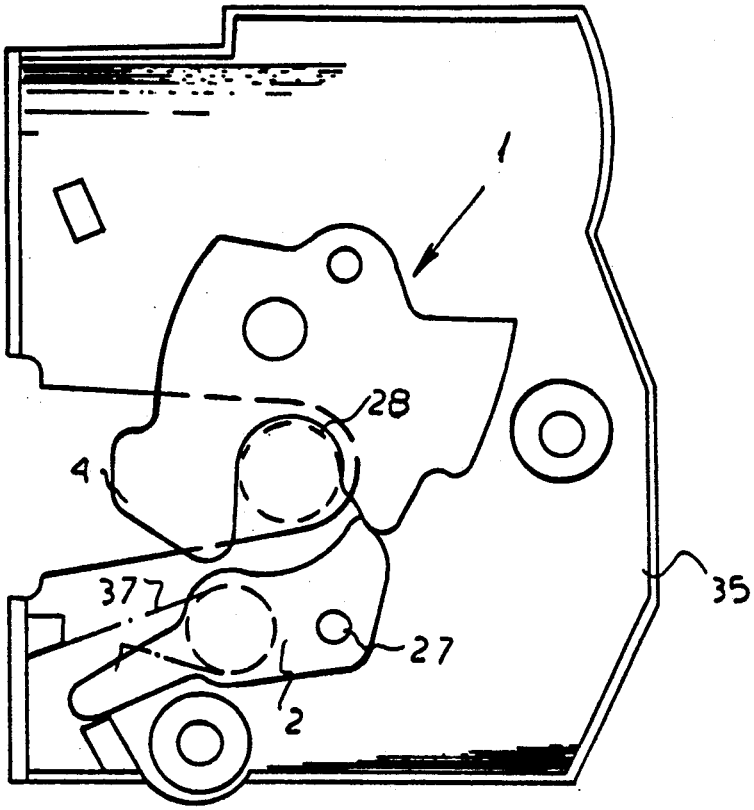
FIG.2
FIG.7
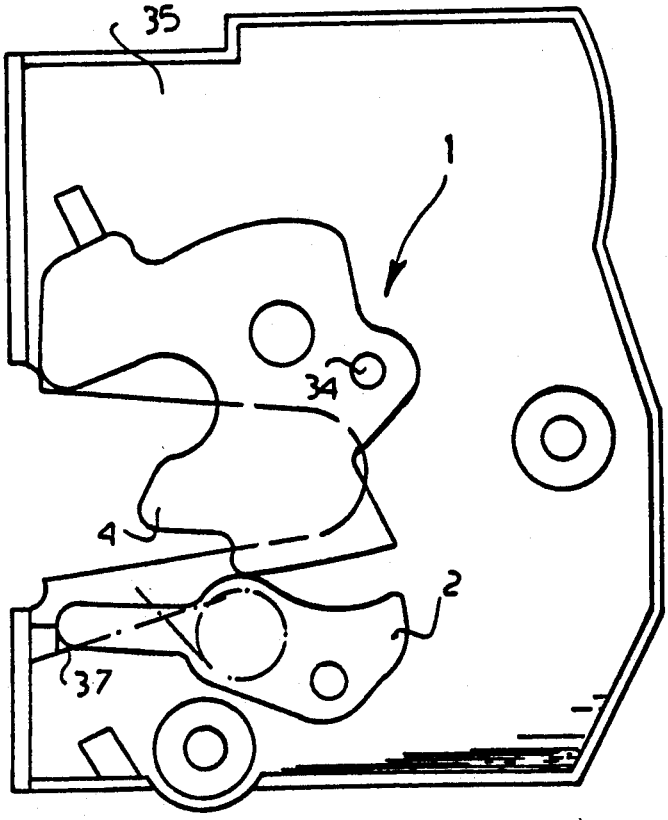

MOTOR-VEHICLE DOOR LATCH

FIELD OF THE INVENTION

The present invention relates to a motor-vehicle door latch. More particularly this invention concerns such a latch which can be locked or unlocked.

BACKGROUND OF THE INVENTION

A standard motor-vehicle door latch has a latching unit comprised of a latching pawl, a release lever, and a pivotal fork or bolt, the latter coacting with a latching block or bolt, as well as an actuating mechanism, a locking mechanism and a coupling mechanism. The actuating mechanism has an outside actuating lever and an inside actuating lever which both are connected to a common actuating lever. The locking mechanism has an inside locking button that is depressed into the door in the locked position, an outside locking lever, and an inside locking lever which is connected to a common inside main locking lever. The coupling mechanism is comprised of a coupling lever or link which in the locked position of the motor-vehicle door latch decouples the inner actuating lever and/or the outer actuating lever. As a result of this decoupling an actuation of the outside or inside door handle does nothing. It is understood that in such a motor-vehicle door latch the latching bolt or block is mounted on the door post or equivalent structure and the other parts of the latch are mounted on the edge of the vehicle door. The term "latching" and "unlatching" are used herein to refer to the acts of, respectively, securing a door closed and freeing a door so it can be opened, and "locking" and "unlocking" are used to refer to the act of making unlatching of the door respectively impossible and possible.

In the prior art such motor-vehicle door latches, on which the instant invention is an improvement, the inner locking knob is pushed down in the locked position. The motor-vehicle door can be unlatched from the inside when the inner actuating lever of the locked motor-vehicle door latch is operated. Thus, the motor-vehicle door can be opened when the inner actuating lever of the door is operated. Thus the motor-vehicle door can be unlocked from the inside without specifically unlocking it. This is not without disadvantages. An inadvertent actuation of the inner actuating lever and the associated structure can lead to opening of the motor-vehicle door which can create a dangerous situation when the vehicle is moving. It is also a problem when the vehicle is moving that an inadvertently locked door cannot simply be unlocked because the door will then simultaneously open. In addition, it is known to provide the above-described motor-vehicle door latch with a mechanism which can be operated from inside the vehicle so as to unlock the door. This is expensive.

Motor-vehicle door latches ar also known constructed such that the inner locking knob is not pushed down to lock the door, but is shaped like a mushroom and is lifted when the door is unlocked. Such an arrangement creates a particularly easy target of theft, in particular with convertible-style windows on the vehicle.

OBJECTS OF THE INVENTION

It is therefore an object of the present invention to provide an improved motor-vehicle door latch.

Another object is the provision of such an improved motor-vehicle door latch which overcomes the above-given disadvantages, that is which has an inside locking element which is depressed to lock the door.

A further object is to provide a latch which cannot be opened by inadvertent actuation of the inside actuating element once it is locked, but which can be readily unlocked from inside.

SUMMARY OF THE INVENTION

A latch for a motor-vehicle door comprises a housing, a door bolt engageable in and separable from the housing, a pivotal lock fork in the housing engageable around the bolt, and a release lever operatively coupled to the lock fork and pivotal in the housing between a blocking position retaining the fork locked around the bolt and a freeing position permitting the fork to release the bolt. Inside and outside latching elements respectively accessible and actuatable from inside and outside the door can each displace a common latching lever pivotal in the housing between a latched position and an unlatched position. Inside and outside locking elements respectively accessible and actuatable from inside and outside the door can similarly displace a common locking lever pivotal in the housing between a locked and an unlocked position. A coupling element connected to the locking lever is displaceable thereby between coupling and uncoupling positions respectively corresponding to the unlocked and locked positions of the locking lever. The coupling element is connected between the latching lever and the release lever only in the coupling position for displacement of the release lever into the freeing position only on displacement of the common latching lever into the unlatched position. A coupling is operatively engaged between the inside latching element and the inside locking element for shifting the latter into the unlocking position on actuation of the former. Thus actuation of the inside latching element with the latch locked unlocks the latch such that subsequent actuation of the inside latching element unlocks the door.

Thus with the system of this invention when the door is locked an inadvertent actuation of the inside door handle will not open it. Instead a single actuation of the inside door handle will merely unlock the door, a second actuation will be needed to unlatch it. On the other hand if the door is locked the user need not meticulously actuate the inside locking element to unlock it before the inside door handle works, instead he or she needs merely to actuate the inside door handle twice to open the door. The system therefore protects the users against accidental door opening while not burdening them with an unwieldy unlocking and unlatching procedure.

According to another feature of this invention the inside locking element includes an inside locking lever pivotal on the housing and an inside locking button depressible into the door for displacing the common locking lever into the locking position. Furthermore the inside latching element includes an inside latching lever pivotal on the housing immediately adjacent the inside locking lever. The coupling according to the invention is connected between the inside levers, being formed as an eccentric entrainment pin on the inside latching lever and an eccentric camming formation on the inside locking lever.

In accordance with further features of this invention the coupling element is a link having one end carried and displaceable on the common locking lever and another end carried and displaceable on the common latching lever. The release lever ha an abutment engageable by the coupling element only in the coupling position thereof on displacement of the common latching lever into the latched position. The coupling element is provided with a coupling pin engageable with the abutment only in the coupling position on displacement of the common latching lever into the latched position. The pin is engageable past the abutment in the uncoupling position of the coupling element and the unlatched position of the common latching lever. In addition a coupling spring is tensioned between the common latching lever and the coupling element. This coupling spring snaps the coupling element into the coupling position once the inside door handle is released to return to its starting position after an initial actuation.

The common locking lever in accordance with the invention an upper pin and the one end of the coupling element is formed with a slot into which the upper pin engages and in which it slides. The common latching lever is formed with a slot in which the coupling pin engages and slides.

DESCRIPTION OF THE DRAWING

The above and other objects, features, and advantages will become more readily apparent from the following, reference being made to the accompanying drawing in which:

FIGS. 1A and 1B are vertical sections, one taken at 90° to the other, through the latch according to this invention in the latched and locked position;

FIG. 2 is a vertical section in a plane parallel to but offset from the section plane of FIG. 1B showing other parts of the latch;

FIG. 7 is a view like FIG. 2 but showing the latch in the unlatched and open position.

SPECIFIC DESCRIPTION

Figures 3A, 3B:
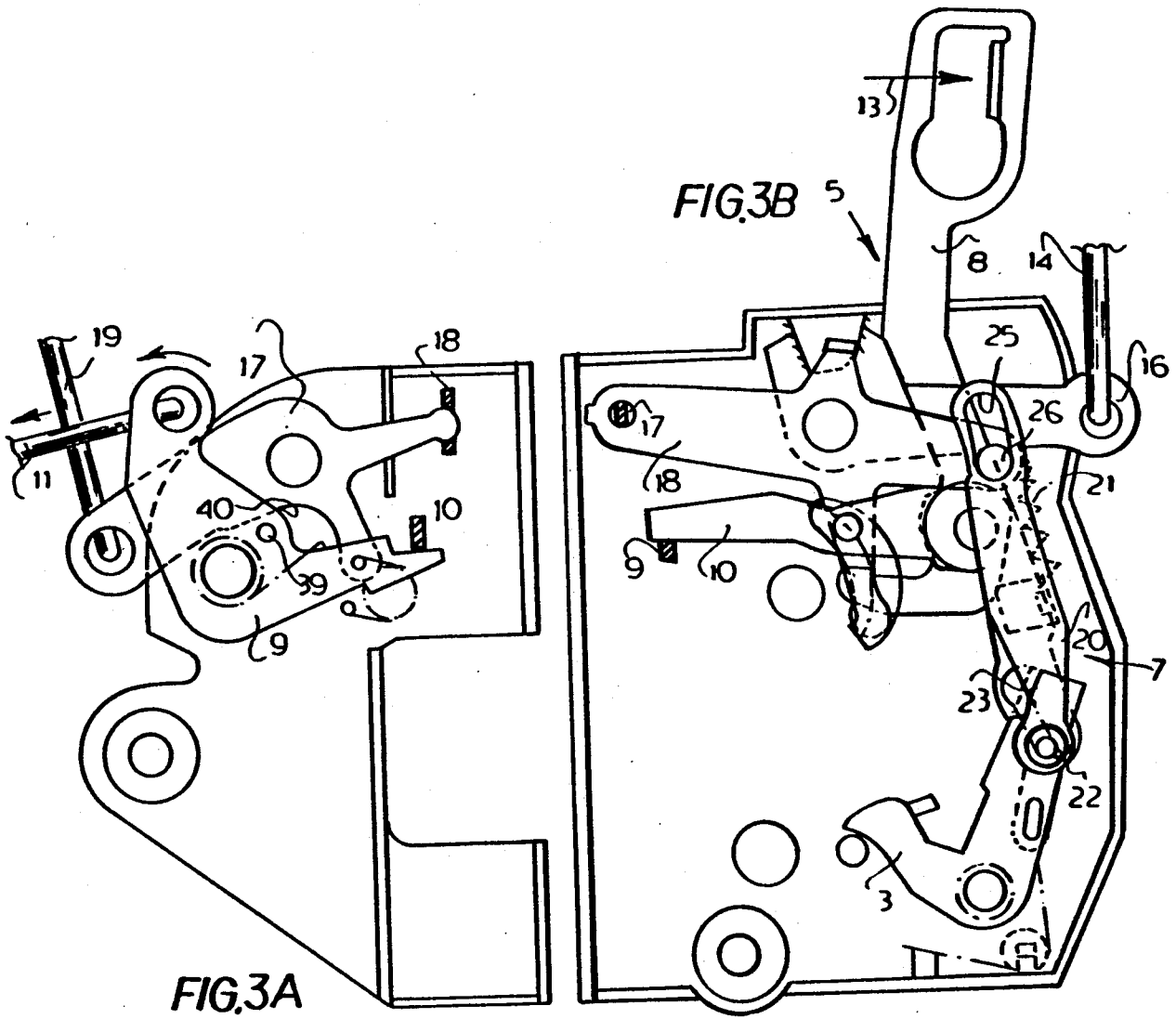
FIGS. 3A and 3B are sections like FIGS. 1A and 1B but with the inside door handle of the latch partially actuated for a first time when the latch is locked.

As seen in FIGS. 1 and 2 a motor-vehicle door latch according to this invention basically comprises a latching unit 1 best seen in FIGS. 2 and 7 and comprising a locking pawl 2 pivotal on a housing part 35, a release lever 3, and a locking fork 4. The parts 2, 3 and 4 are all pivoted on the housing part 35 about parallel axes. The fork 4 can engage over a bolt 28 normally projecting from a door post. A pin 27 on the pawl 2 can be engaged by one end of the release lever 3 to pull the pawl 2 against the force of a return spring 37 out of engagement with the bolt 4 to release same in the manner well known per se. The fork 4 also carries a pin 34 cooperating with structure in the latch that will be described below for preventing the latch from remaining locked when the door is shut while the latch is locked.

The housing part 35 contains a latching mechanism 5 serving to operate the release lever 3, a locking unit 6 carried in an associated housing part 36 extending at a right angle to the part 35, and a coupling unit 7 that prevents the latching unit 5 from acting on the release lever 3 unless the locking unit 6 is in the unlocked position.

The latching mechanism 5 basically comprises a lever 8 connected as indicated schematically at 13 to an outside door handle 29, an inside actuating lever 9 connected via a rod 11 to an inside door handle 12, and a common actuating lever 10 pivoted on the housing part 35 and operable by either of the levers 8 or 9. Springs 31 and 32 bias the lever 8 and handle 12 into the illustrated positions.

The locking mechanism 6 basically comprises an inside locking button 15 connected via a rod 19 to an inside locking lever 17 movable adjacent the lever 9 between two end positions in which it is held by a toggle spring 33 and an outside locking cylinder 30 connected via a rod 14 to an outside locking lever 16. The levers 16 and 17 are respectively carried on the housing parts 35 and 36 and both are coupled to a common locking lever 18 pivoted on the part 35 and having a depending arm 38 that can be engaged by the element 34 on the bolt 4 to prevent the latch from remaining locked when the door is closed.

The coupling mechanism 7 basically comprises a coupling link 20 having an upper end formed with a slot 25 into which fits a pin 26 carried on one end of the locking lever 18, and a lower end provided with a pin 22 slidable in a vertically elongated slot 24 formed in one end of the common latching lever 10, and also engageable with a abutment 23 formed on the release lever 3. This link 20 is vertically displaceable between a lower decoupling position in which the pin 22 is in the lower end of the slot 24 and its arcuate path of travel, which is centered on the pivot axis of the lever 10, is below the abutment 23 and an upper coupling position with the pin 22 in the upper end of the slot 24 and engageable on pivoting of the lever 20 with the abutment 23.

A comparison of FIGS. 1A, 1B, 3A, 3B, 4A, and 4B shows that the locking mechanism 6 is indirectly connected with the inner actuating lever 9 and is shiftable out of the latching position in a first or unlatching stroke of the inner actuating lever 9. To this end the lever 9 is provided offset from its pivot with a camming pin 39 that coacts with a camming surface 40 formed on the inside lever 17 offset from its pivot. Thus an actuation of the inner handle 12 to open the door will also pivot the lever 17 in a direction tending to unlock the door.

Figure 4B:
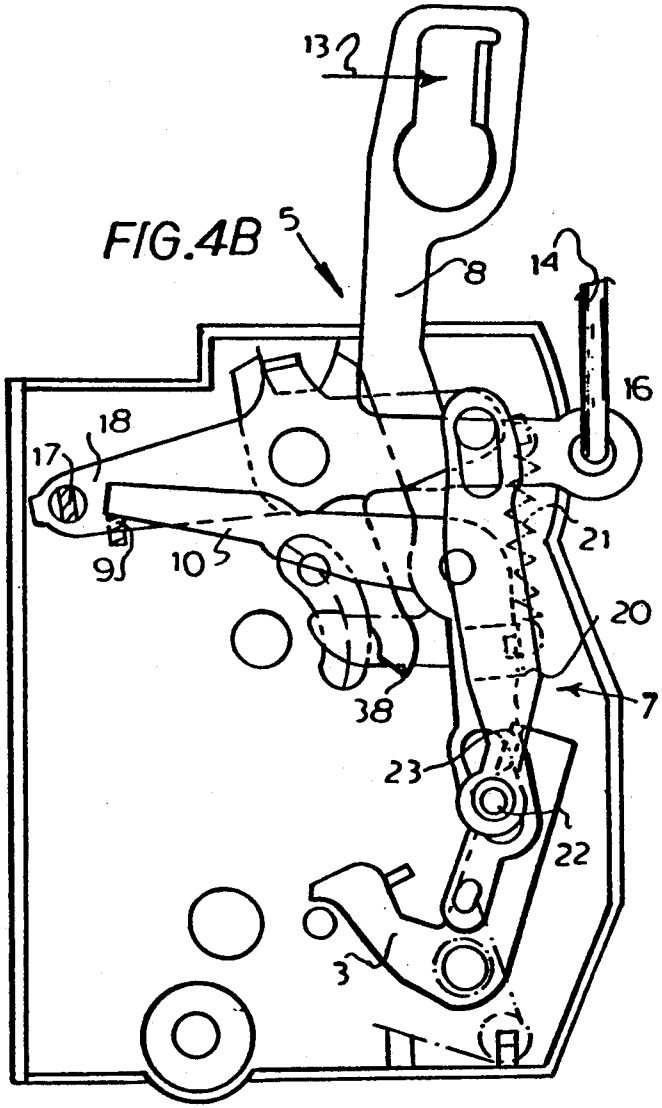
FIGS. 4A and 4B are sections like FIGS. 1A and 1B but showing the parts when the inside latch is fully actuated for the first time with the latch locked.
Figure 4A:
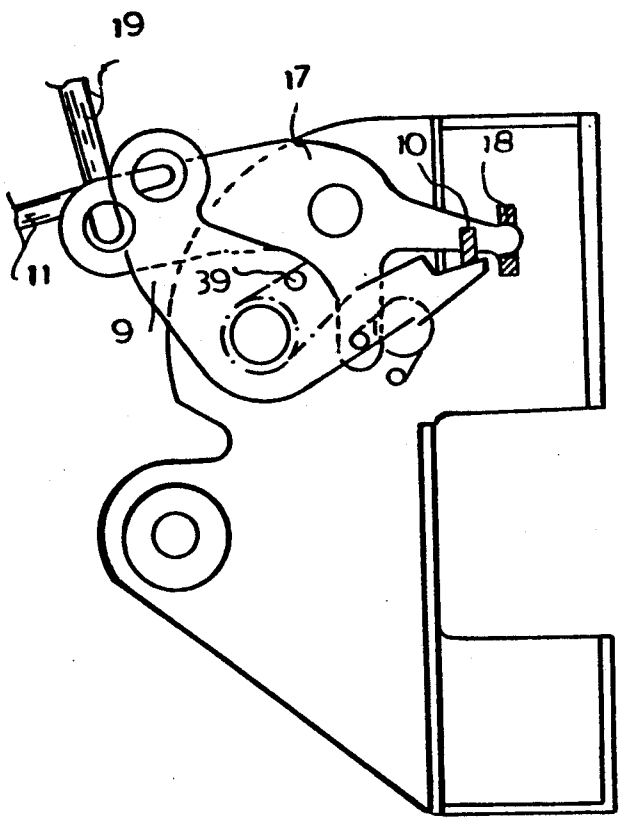

FIGS. 3A and 3B show the inner actuating lever 9 moved through a portion of its stroke on a first actuation with the latch in the locked position. This action is not enough to bring the pin 39 into contact with the surface 40, but is enough to pull the pin 22 under the abutment 23. In FIGS. 4A and 4B the first unlocking stroke is at its end, with the pin 39 having pivoted the lever 9 into its other end position, thereby pushing up the button 15 and pivoting the lever 18 counterclockwise. This tensions a spring 21 coupled with the coupling link 20 because the pin 22 remains caught underneath the abutment 23 Nonetheless this action does not unlatch the door because the lever 3 has not been pivoted at all.

Figure 5B:
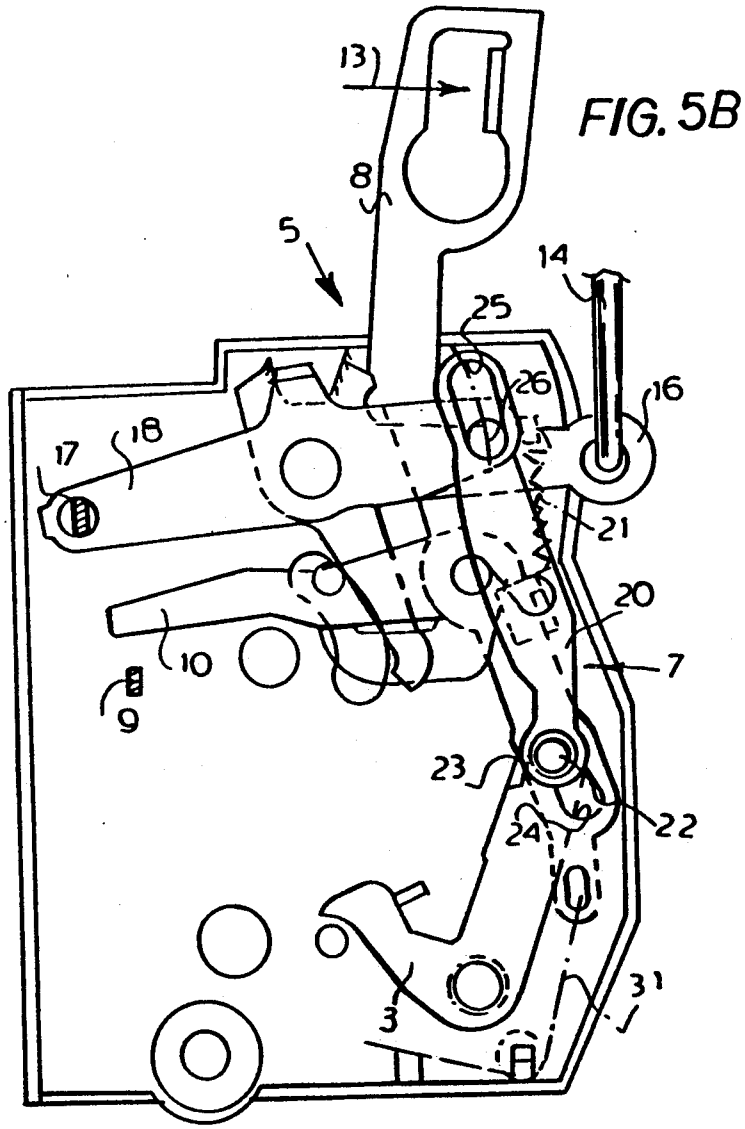
FIGS. 5A and 5B are sections like FIGS. 1A and 1B but showing the parts after the first actuation of the inside handle.
Figure 5A:
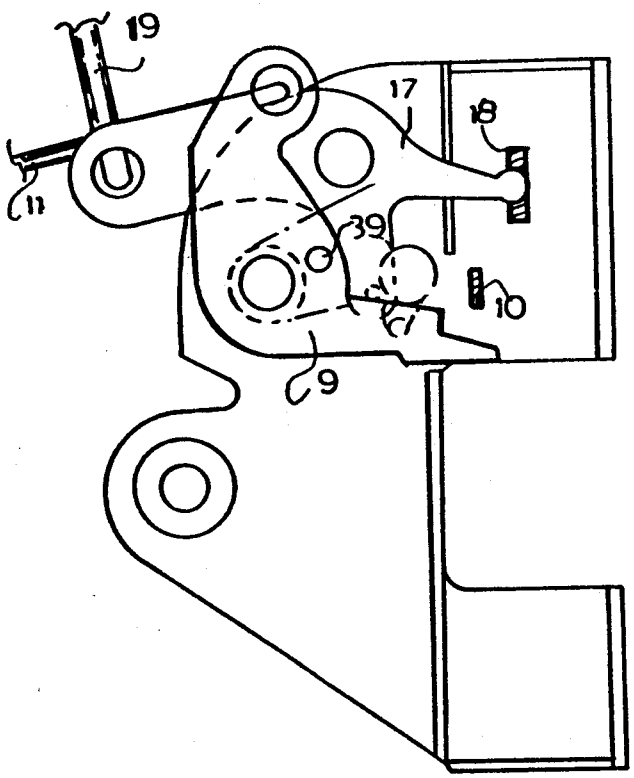

Subsequently when the inner actuating lever 9 leaves the position of FIGS. 4A and 4B as seen in FIGS. 5A and 5B, the coupling link 20 is moved by the coupling spring 21 from the uncoupled position into the coupling position, as this action moves the pin 22 out from beneath the abutment 23. The coupling link 20 then jumps into the coupling position under the force of the spring 21.

Figure 6B:
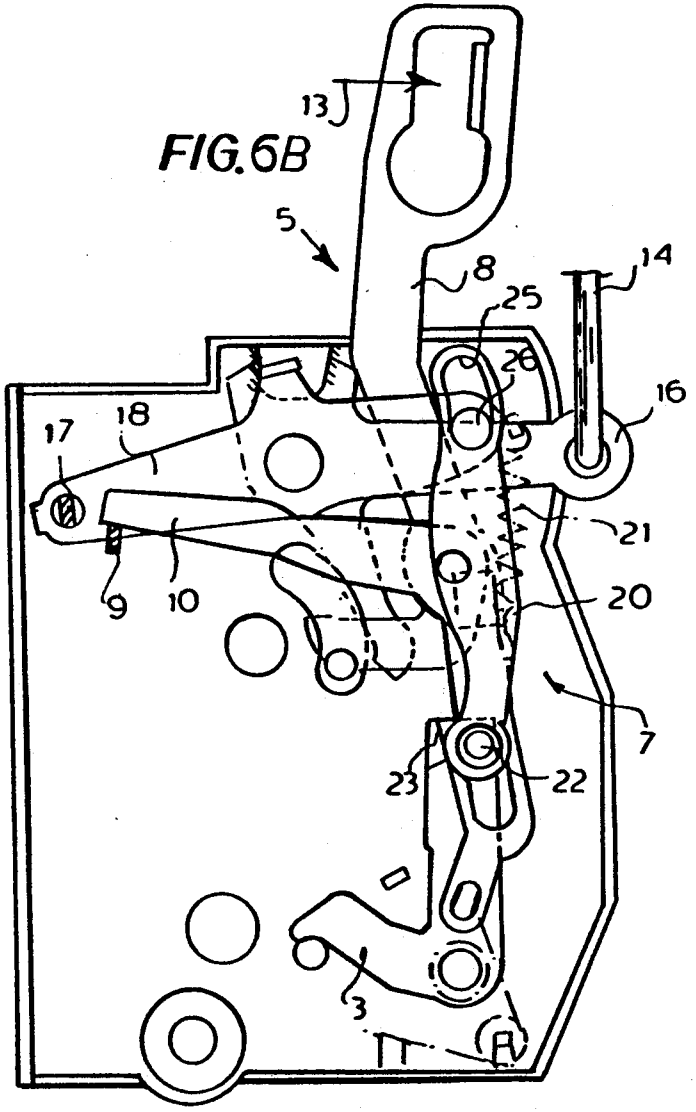
FIGS. 6A and 6B are sections like FIGS. 1A and 1B but showing the parts when the inside door handle is actuated for a second time.
Figure 6A:
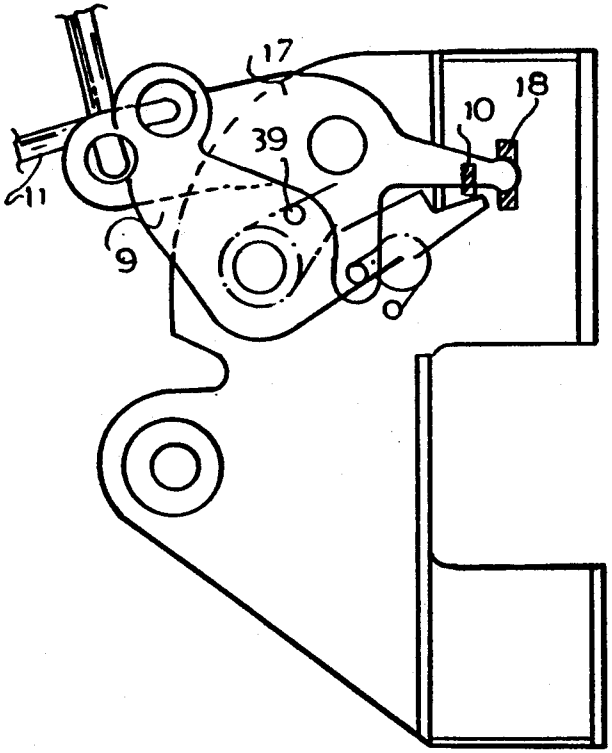

Thereafter as seen in FIGS. 6A and 6B the latching unit 1 can be opened by a second actuation or opening stroke of the inner actuating lever 9, so as thereby to open the motor-vehicle door latch completely. This is possible because once the coupling lever is in the upper coupling position, clockwise pivoting of the lever 10 brings the pin 22 flatly against the abutment 23 and pushes the lever 3 counterclockwise, releasing the pawl 2. It is understood that the latching unit 1, once the coupling link 20 has assumed the coupling position, can also be unlatched from the outside lever 8, that is via the outer door handle 29, once the parts are in the position of FIGS. 5A and 5B.

Thus with the system of this invention, when the door is locked as shown in FIGS. 1A and 1B, an actuation of the inside door handle 12 will unlock the door but will not open it. A second actuation of the inside door handle 12 or an actuation of the outside door handle 29 will then unlatch the door. An accidental actuation of the inside door handle of a locked door will therefore not open the door, but on the other hand a locked door can be opened by operating the inside door handle twice, something that cannot happen accidentally but that is a lot easier than operating both the inside door lock and then the inside door handle.

We claim:

1. A latch for a motor-vehicle door, the latch comprising:

a housing;

a door bolt engageable in and separable from the housing;

a pivotal lock fork in the housing engageable around the bolt;

a release lever operatively coupled to the lock fork and pivotal in the housing between a blocking position retaining the fork locked around the bolt and a freeing position permitting the fork to release the bolt, the release lever having an abutment;

inside and outside latching elements respectively accessible and actuatable form inside and outside the door;

a common latching lever pivotal in the housing, formed with a slot, and displaceable by either of the latching elements between a latched position and an unlatched position;

inside and outside locking elements respectively accessible and actuatable form inside and outside the door;

a common locking lever pivotal in the housing, carrying an upper pin, and displaceable by either of the locking elements between a locked and an unlocked position;

a coupling link connected to the locking lever and displaceable thereby between coupling and uncoupling positions respectively corresponding to the unlocked and locked positions of the locking lever, the coupling link having one end carried formed with a slot into which a upper pin engages and in which it slides, another end carried and displaceable on the common latching lever, and a coupling pin engaging and slidable in the latching-lever slot and engageable with the abutment of the release lever only in the coupling position for displacement of the release lever into the freeing position only on displacement of the common latching lever into the unlatched position; and coupling means operatively engaged between the inside latching element and the inside locking element for shifting the latter into the unlocking position on actuation of the former, whereby actuation of the inside latching element with the latch locked unlocks the latch such that subsequent actuation of the inside latching element unlocks the door.

2. The motor-vehicle door latch defined in claim 1 wherein the inside locking element includes an inside locking lever pivotal on the housing and an inside locking button depressible into the door for displacing the common locking lever into the locking position.

3. The motor-vehicle door latch defined in claim 2 wherein the inside latching element includes an inside latching lever pivotal on the housing immediately adjacent the inside locking lever, the coupling means being connected between the inside levers.

4. The motor-vehicle door latch defined in claim 1 wherein the coupling pin is engageable past the abutment in the uncoupling position of the coupling link and the unlatched position of the common latching lever.

5. A latch for a motor-vehicle door, the latch comprising:

a housing;

a door bolt engageable in and separable from the housing;

a pivotal lock fork in the housing engageable around the bolt;

a release lever operatively coupled to the lock fork and pivotal in the housing between a blocking position retaining the fork locked around the bolt and a freeing position permitting the fork to release the bolt, the release lever having an abutment;

inside and outside latching elements respectively accessible and actuatable from inside and outside the door;

a common latching lever pivotal in the housing and displaceable by either of the latching elements between a latched position and an unlatched position;

inside and outside locking elements respectively accessible and actuatable from inside and outside the door;

a common locked lever pivotal in the housing and displaceable by either of the locking elements between a locked and an unlocked position;

a coupling link connected to the locking lever and displaceable thereby between coupling and uncoupling positions respectively corresponding to the unlocked and locked positions of the locking lever, the coupling link having one end carried and displaceable on the common locking lever, another end carried and displaceable on the common latching lever, and a coupling pin engageable with the abutment of the release lever only on the coupling position for displacement of the release lever into the freeing position only on displacement of the common latching lever into the unlatched position, the pin being engageable past the abutment in the uncoupling position of the coupling link and the unlatched position of the common latching lever; and coupling means operatively engaged between the inside latching element and the inside locking element for shifting the latter into the unlocking position on actuation of the former, whereby actuation of the inside latching element with the latch locked unlocks the latch such that subsequent actuation of the inside latching element unlocks the door; and a coupling spring tensioned between the common latching lever and the coupling link.

* * * * *